US005205907A

United States Patent [19]

Fortier

[11] Patent Number: 5,205,907

[45] Date of Patent: Apr. 27, 1993

[54] REMOVAL OF MANGANESE FROM PULP USING A CHELATING AGENT AND MAGNESIUM SULPHATE

[75] Inventor: Denis G. Fortier, Burnaby, Canada

[73] Assignee: MacMillan Bloedel Limited, Vancouver, Canada

[21] Appl. No.: 796,952

[22] Filed: Nov. 25, 1991

[51] Int. Cl.[5] ..... D21C 3/04

[52] U.S. Cl. ..... 162/76; 162/78; 162/82

[58] Field of Search ..... 162/78, 79, 82, 76

[56] References Cited

U.S. PATENT DOCUMENTS

| | | | |
|---|---|---|---|
| 3,860,391 | 1/1975 | Kling et al. | 162/77 |
| 4,160,693 | 7/1979 | Lindahl et al. | 162/78 |
| 4,614,646 | 9/1986 | Christiansen | 162/78 |
| 4,731,161 | 3/1988 | Ehrhardt | 162/78 |
| 4,732,650 | 3/1988 | Michalowski et al. | 162/76 |
| 4,798,652 | 1/1989 | Joyce et al. | 162/78 |
| 4,849,053 | 7/1989 | Gentile, Jr. et al. | 162/76 |
| 4,915,785 | 4/1990 | Siminoski et al. | 162/78 |
| 4,938,842 | 7/1990 | Whiting et al. | 162/78 |

FOREIGN PATENT DOCUMENTS

| | | |
|---|---|---|
| 1249403 | 1/1989 | Canada . |
| 7844564 | 11/1978 | Japan . |
| 56-169890 | 12/1981 | Japan . |

OTHER PUBLICATIONS

Factors Affecting Hydrogen Peroxide Stability in the Brightening of Mechanical and Chemi-Mechanical Pulps. Part III: Hydrogen Peroxide Stability in the Presence of Magnesium and Combinations of Stabilizers, Colodette, J. L.; Rothenberg, S.; Dence, C. W. from The Journal of Pulp and Paper Science: vol. 15, No. 2, Mar. 1989.

*Primary Examiner*—W. Gary Jones
*Assistant Examiner*—Dean Nguyen
*Attorney, Agent, or Firm*—C. A. Rowley

[57] ABSTRACT

The removal of manganese from pulp is enhanced by supplementing the treatment with a chelating agent by the addition of at least 500 ppm of magnesium ions prior to thickening of the pulp thereby to reduce the manganese content of the thickened pulp significantly more than the content would be reduced by the treatment with the chelating agent without the magnesium ions.

8 Claims, 2 Drawing Sheets

REMOVAL OF MANGANESE FROM PULP USING A CHELATING AGENT AND MAGNESIUM SULPHATE

FIELD OF THE INVENTION

The present invention relates to manganese separation from wood pulps and the like. More particularly the present invention relates to the use of magnesium ions to displace manganese from the pulp.

BACKGROUND OF THE PRESENT INVENTION

It has long been known in the pulp and paper industry that the manganese in mechanical pulp is likely to have an adverse effect on the bleaching operating, particularly if the bleaching is to be done with a peroxide such as hydrogen peroxide. To remove the manganese and other metals from pulp it is conventional practise to treat the pulp with a chelating agent such as sodium diethylene triamine penta-acetate (DTPA) and then thicken.

From extensive previous investigations, it has been determined that a change of as little as 5 ppm in the manganese at the lower levels of Mn normally required for bleaching, i.e. a reduction of manganese content by 5 ppm can result in a measurable increase in brightening when brightening using peroxide on mechanical pulp.

The use of magnesium sulphate together with peroxide, particularly hydrogen peroxide, to stabilize the hydrogen peroxide in the presence of sodium silicate is well-known for peroxide bleaching and the concept of adding magnesium sulphate to pulp as a stabilizer for peroxide (without sodium silicate) has also been described in literature—see Japanese patent publication 78-44564 published Nov. 30, 1978, inventor Yotsuy, Japanese application 56169890 published Dec. 26, 1981 Mitsubishi Gas and Chemical Inc, which describes a process of refiner bleaching by the addition of magnesium compounds to the chips before the addition of hydrogen peroxide and refining of the chips in the refiner.

Canadian patent 1,249,403 also describes the brightening of high yield or ultra high yield pulps wherein magnesium sulphate is present during a bleaching reaction with hydrogen peroxide.

U.S. Pat. No. 4,731,161 issued Mar. 15, 1988 to Ehrhardt describes the method of bleaching wherein a bleaching solution contains magnesium salts and hydrogen peroxide is used for bleaching chemical pulps.

BRIEF DESCRIPTION OF THE PRESENT INVENTION

It is an object of the present invention to provide an improved system for removing manganese from paper making pulp.

Broadly the present invention relates to a method of enhancing removal of manganese from wood pulps containing manganese comprising applying a suitable chelating agent to said pulp, applying magnesium ions to said pulp in an amount of at least 500 ppm based on the oven dried weight of the pulp to provide a treated pulp having a consistency of less than about 5%, thickening said pulp to a consistency of at least 12% by dewatering of said pulp to thereby remove an amount of manganese from said pulp greater than the amount of manganese than would be separated if said pulp were treated with said chelating agent but without the addition of the magnesium ions.

Preferably said magnesium ions are added to said pulp in the form of magnesium sulphate ($MgSO_4$).

Preferably said magnesium ions will be applied to said pulp in an amount to add 1,000 to 3,000 ppm magnesium ions to said pulp.

BRIEF DESCRIPTION OF THE DRAWINGS

Further features, objectives and advantages will be evident from the following detailed description of the preferred embodiments of the present invention taken in conjunction with the accompanying drawings in which.

DESCRIPTION OF THE PREFERRED EMBODIMENTS

Figure 1:
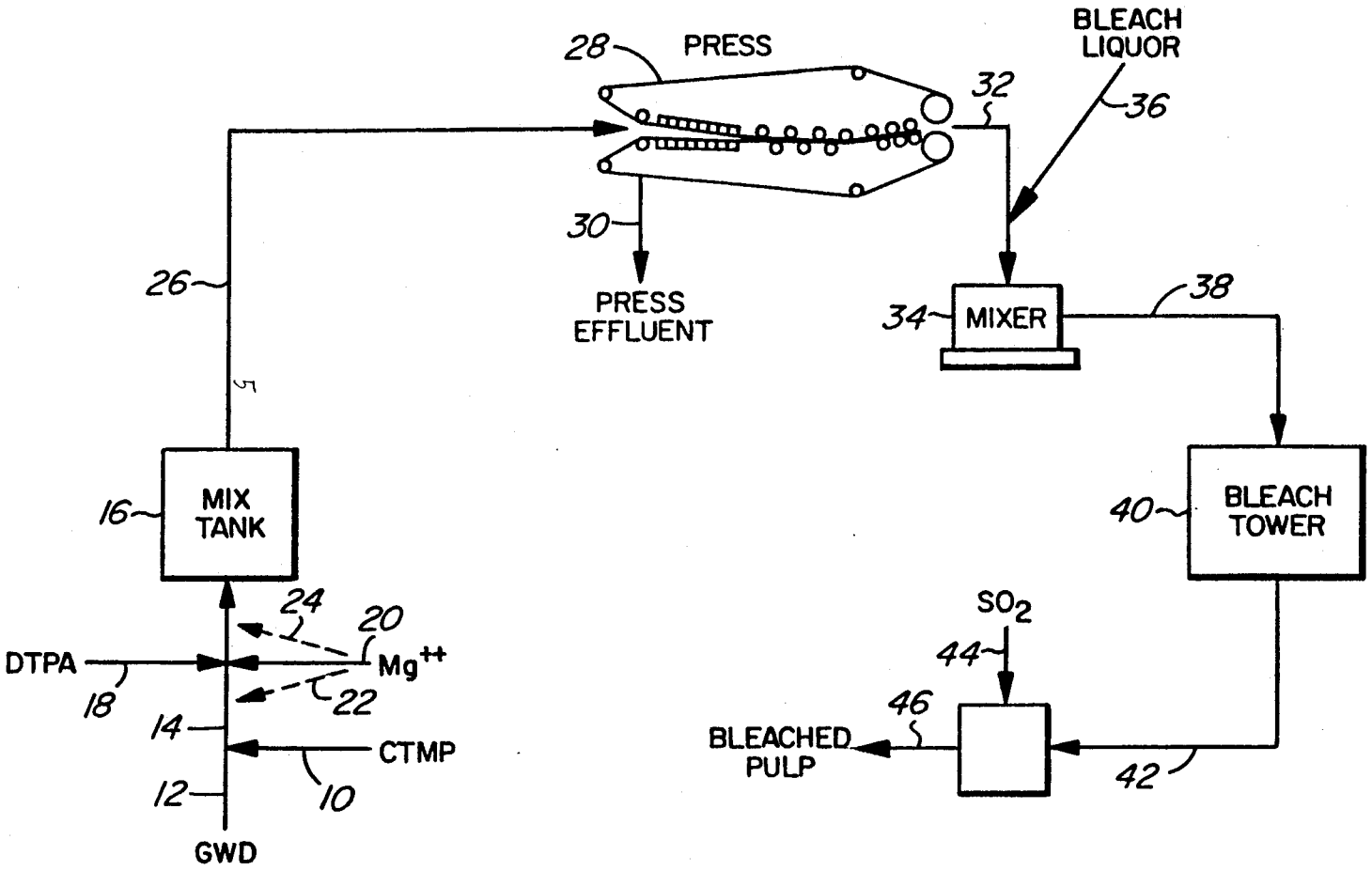
FIG. 1 is a schematic illustration of a bleaching process incorporating the present invention.

FIG. 1 shows one typical arrangement or system for bleaching pulp illustrating the point at which the magnesium ions are added into the process.

As shown in FIG. 1, pulp such as chemithermomechanical (CTMP) indicated at 10 or groundwood 12 or any other suitable pulp, passes via line 14 to a mixed tank 16 and DTPA (a suitable chelating agent) is added as indicated at 18, either to the line 14 or directly into the mix tank 16 and the magnesium ions are added as indicated at 20 either before the addition of DTPA as indicated by the dotted line 22 or after as indicated by the dotted line 24 or at the same time as indicated by the solid line or directly into the mix tank 16.

The pulp in mixer 16, generally at a consistency of less than 5%, mixes with the added chelating agent and magnesium ions and then passes via line 26 to a suitable press 28 wherein liquid is squeezed therefrom in the form of press effluent leaving the press as indicated at 30. The treated pulp leaves the press and passes as indicated via line 32 into a second mixer 34 (high consistency mixer) and bleach liquor is added either in line 32 or in mixer 34 as indicated at 36. The pulp in line 32 is generally at a consistency of about 30% or higher and is diluted to a degree by the addition of the bleach liquor 36. The consistency of the pulp in line 32 may be also significantly less than 30 depending on the process being used, i.e. is the bleaching at high consistency or medium consistency or low consistency.

In any event the pulp with the bleaching liquor added and mixed therewith is passed via line 38 to a bleach tower where the pulp is held for the appropriate time and at the appropriate temperature to bleach the pulp, i.e. generally between about 60° C. and 90° C. for a period of 1 to 6 hours. The bleached pulp in line 42 is soured as indicated by the addition of $SO_2$ at 44 and bleached pulp leaves the system as indicated via line 46 and is used as desired.

In a conventional process only the chelating agent (generally DTPA) is added and mixed with the pulp before the press 28 so that the effluent in line 30 contains only that amount of manganese that is separated from the pulp by the chelating agent. When the present invention is used and magnesium ions are applied as above described, the press efluent in line 30 contains significantly more manganese than if the pulp were treated only with the chelating agent DTPA, i.e. when magnesium ions are added in the amount of at least 500 ppm, preferably at least 750 ppm based on the oven dried weight of the pulp, the manganese content of the thickened pulp in line 32 will be reduced by a further at least 5 ppm based on the oven dried weight of the pulp, more than would be obtained if no magnesium ions were added.

EXAMPLE 1

Mechanical pulp from applicant's Powell River mill was taken from the process just after the addition of DTPA and while the pulp was still at a low consistency of about 3.5. Samples of this pulp were then treated with magnesium sulphate and thickened and a control sample was produced by simply thickening a portion of the pulp taken from the process. The results are shown in Table 1.

TABLE 1

| $MgSO_4$ Added, % Weight based on oven dry weight of pulp | $Mg^{++}$ added ppm × 1000 | Mn, ppm |
|---|---|---|
| 0 | 0 | 22.4 |
| 3 | 6 | 14.9 |
| 4 | 8 | 14.0 |
| 4 | 8 | 13.4 |
| 5 | 10 | 12.7 |
| 6 | 12 | 13.1 |

EXAMPLE 2

Figure 2:
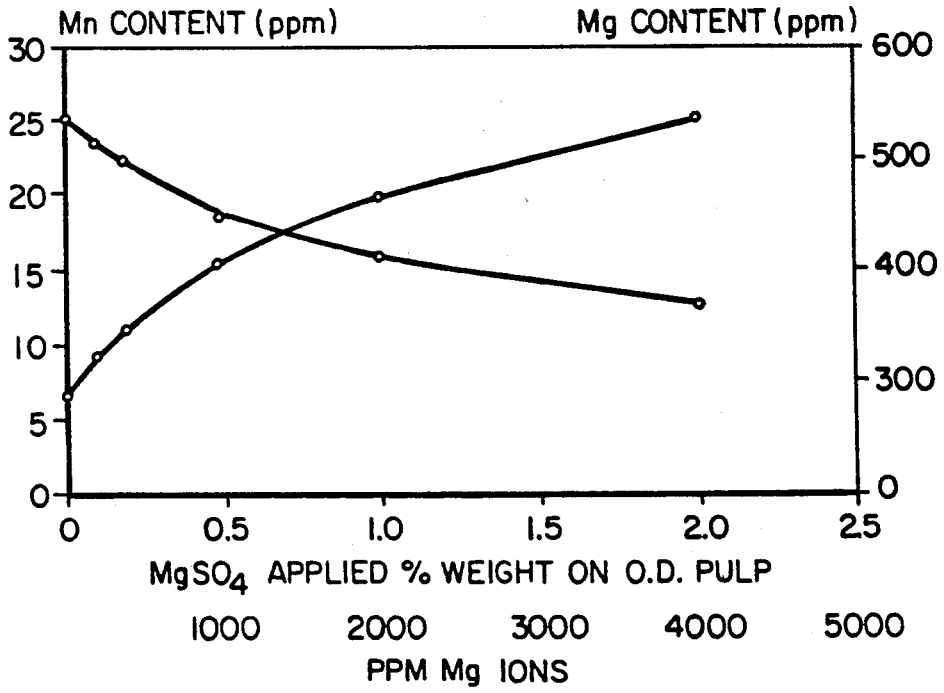
FIG. 2 is a plot of manganese and magnesium content as a function of the amount of magnesium sulphate applied.

A second large sample of pulp taken from the same mill at the same location, before thickening, was found to have a manganese content of 147 ppm. Various samples of this pulp were mixed with differing amounts of magnesium sulphate and each thickened to approximately 28.5% consistency based on the oven dried weight of the pulp. The results of these tests have been plotted in FIG. 2 with each data point representing an average of three separate experiments. Curves 100 and 200 represent the Mg and Mn contents of the pulp respectively.

It is clear that the addition of magnesium enhances removal of manganese with the more magnesium added the greater the removal of the manganese. However it is also apparent that above about 2,000 ppm of magnesium ions, i.e. 1% magnesium sulphate, the increased benefits are modest.

The addition of about 500 ppm magnesium ions added reduced the manganese content from about 26 ppm to in the order of about 21 ppm for a total reduction when the magnesium ions were added of at least 5 ppm which in a bleaching operation will make a significant difference in the effectiveness of the peroxide bleaching.

Having described the invention, modifications will be evident to those skilled in the art without departing from the spirit of the invention as defined in the appended claims.

I claim:

1. A method of enhancing removal of manganese from wood pulps containing manganese comprising applying a suitable chelating agent to said pulp, applying magnesium ions to said pulp in an amount of at least 500 ppm based on the oven dried weight of the pulp to provide a treated pulp substantially free of bleaching chemical having a consistency of less than about 5%, thickening said treated pulp to a consistency of at least 12% by dewatering of said treated pulp to thereby remove an amount of manganese from said pulp greater than the amount of manganese than would be separated if said pulp were treated with said chelating agent but without the addition of the magnesium ions.

2. A method as defined in claim 1 wherein said magnesium ions are added to said pulp in the form of magnesium sulphate ($MgSO_4$).

3. A method as defined in claim 2 wherein said magnesium ions are applied to said pulp in an amount to add 1,000 to 3,000 ppm magnesium ions to said pulp.

4. A method as defined in claim 3 wherein said pulp is a mechanical or chemithermo-mechanical pulp.

5. A method as defined in claim 2 wherein said pulp is a mechanical or chemithermo-mechanical pulp.

6. A method as defined in claim 1 wherein said magnesium ions are applied to said pulp in an amount to add 1,000 to 3,000 ppm magnesium ions to said pulp.

7. A method as defined in claim 6 wherein said pulp is a mechanical or chemithermo-mechanical pulp.

8. A method as defined in claim 1 wherein said pulp is a mechanical or chemithermo-mechanical pulp.

* * * * *